US009476416B2

(12) United States Patent
Chen

(10) Patent No.: US 9,476,416 B2
(45) Date of Patent: Oct. 25, 2016

(54) AIR COMPRESSOR

(71) Applicant: Chi-Wen Chen, New Taipei (TW)

(72) Inventor: Chi-Wen Chen, New Taipei (TW)

( * ) Notice: Subject to any disclaimer, the term of this patent is extended or adjusted under 35 U.S.C. 154(b) by 315 days.

(21) Appl. No.: 14/086,988

(22) Filed: Nov. 22, 2013

(65) Prior Publication Data

US 2015/0147208 A1 May 28, 2015

(51) Int. Cl.

| | |
|---|---|
| ***F04B 39/02*** | (2006.01) |
| ***F04B 39/06*** | (2006.01) |
| ***F04B 39/16*** | (2006.01) |
| ***F04B 39/00*** | (2006.01) |
| ***F04B 39/12*** | (2006.01) |

(52) U.S. Cl.

CPC ..... *F04B 39/066* (2013.01); *F04B 39/0094* (2013.01); *F04B 39/123* (2013.01); *F04B 39/16* (2013.01)

(58) Field of Classification Search

CPC F04B 39/066; F04B 39/0094; F04B 39/123; F04B 39/16; F04B 49/06; F04B 41/06; F04B 39/12; F04B 39/121; F04B 39/06; F04B 53/16; F04D 25/16; F04D 25/163; F04D 25/166; F04D 29/70; F04D 29/701; F04D 29/703; F04D 29/403; F04D 29/5806; F04D 29/582

USPC ..... 417/366, 234; 310/62, 63

See application file for complete search history.

(56) References Cited

U.S. PATENT DOCUMENTS 2,106,488 A * 1/1938 McCune ..... F04B 27/053 417/203
D273,958 S * 5/1984 Mariol ..... D15/9
4,789,310 A * 12/1988 Hung ..... A47L 5/24 15/339
5,352,096 A * 10/1994 Chi-Wen ..... F04B 49/02 417/12
6,011,331 A * 1/2000 Gierer ..... H02K 29/06 310/52
6,116,864 A * 9/2000 Veser ..... A01G 1/125 417/364
6,431,839 B2 * 8/2002 Gruber ..... 415/76
6,485,266 B2 * 11/2002 DeRuyter ..... F04B 39/066 417/201
6,692,240 B1 * 2/2004 Leonhard ..... F04B 39/066 310/62
6,991,436 B2 * 1/2006 Beckman ..... F04B 39/066 417/201
7,001,156 B2 * 2/2006 Chen ..... F04B 35/04 417/313
7,037,084 B2 * 5/2006 King ..... F04D 29/4226 417/368
7,225,959 B2 * 6/2007 Patton ..... B25C 1/04 173/217

(Continued)

*Primary Examiner* — Charles Freay
(74) *Attorney, Agent, or Firm* — Leong C. Lei

(57) ABSTRACT

The air compressor contains a casing member, a driving member, and a cylinder member. The casing member has a first accommodation section, a second accommodation section, and a connection section connecting the first and second accommodation sections. The first accommodation section has a number of first inlets and first outlets. The driving member is located between the first and second accommodation sections, and is adjacent to the first outlets. The cylinder member is located both in the second accommodation section and the connection section, and is adjacent to the second outlets. The outside cool air is drawn into the casing member through the first inlets. A portion of the drawn air is released through the first outlets, forming a first flow path for cooling down the driving member. Another portion is released through the second outlets, forming a second flow path for cooling down the cylinder member.

2 Claims, 4 Drawing Sheets

(56) References Cited

U.S. PATENT DOCUMENTS 7,494,035 B2 * 2/2009 Weaver ..... B25C 1/04 173/217
8,147,216 B2 * 4/2012 Schiffhauer ..... F04B 17/03 310/54
8,246,327 B2 * 8/2012 Otte, Jr. ..... F04B 27/005 417/423.14
8,770,341 B2 * 7/2014 Wood ..... F04B 23/10 181/229
8,784,072 B2 * 7/2014 Burke ..... B30B 9/125 417/201
8,899,378 B2 * 12/2014 Wood ..... F04B 23/10 181/229
8,920,138 B2 * 12/2014 Schiffhauer ..... F04B 1/12 417/366
2001/0014290 A1 * 8/2001 Takura ..... F04D 1/006 417/371
2001/0036410 A1 * 11/2001 DeRuyter ..... F04B 39/066 417/201
2003/0124004 A1 * 7/2003 Dreiman ..... F04B 35/04 417/366
2004/0018098 A1 * 1/2004 Beckman ..... F04B 39/066 417/234
2006/0222530 A1 * 10/2006 Huang ..... F04B 35/04 417/415
2007/0059186 A1 * 3/2007 Weaver ..... B25C 1/04 417/234
2007/0207043 A1 * 9/2007 Hahn ..... B08B 3/026 417/234
2008/0124227 A1 * 5/2008 Huang ..... F04B 35/06 417/234
2011/0123353 A1 * 5/2011 Hill ..... F04B 35/04 417/44.6
2011/0158828 A1 * 6/2011 Nutz ..... F04B 35/06 417/234
2011/0182754 A1 * 7/2011 Gathers ..... F02B 63/04 417/234
2013/0062141 A1 * 3/2013 Wood ..... F04B 23/10 181/229

* cited by examiner

AIR COMPRESSOR

TECHNICAL FIELD OF THE INVENTION

The present invention is generally related to air compressor, and more particular to an air compressor capable of conducting outside cool air through the air compressor through multiple air flow paths for effectively and speedily cooling down the motor and cylinder of the air compressor.

DESCRIPTION OF THE PRIOR ART

An air compressor is a device that can release compressed and pressurized in quick bursts, and is commonly applied to power pneumatic tools, to pump tires, etc. It therefore has become a necessity for home and auto repairmen.

A major issue for air compressor is the heat produced by its motor and cylinder, and the heat is accumulated over time as the air compressor is continuously operated. If the air compressor is overheated, its performance is deteriorated, or its motor or cylinder is burned down, directly or indirectly affecting the applicability and life span of the air compressor.

The overheating problem is conventionally resolved by configuring a fan on the shaft of the motor. As the motor is actuated, the fan spins to draw in cool air and to dissipate the heat. However, the cylinder of the air compressor is usually not located on the air flow path, and its heat is not dissipated satisfactorily. It is often found that the cylinder is at a much higher temperature than the motor. As the cylinder is effectively cooled down, the overheating problem of the air compressor remains.

Therefore, most users have to stop the air compressor, and wait for a while for the cylinder to cool down before resuming the operation of the air compressor.

In other words, both the cylinder and the motor are heat sources of the air compressor. To resolve the overheating problem, both the cylinder and the motor have to be appropriately dissipated, instead of just one of them.

In addition, conventionally, both the cylinder and the motor are housed in a single casing for reducing their noises. The heat produced by the motor and the cylinder is as such accumulated together, and this is also why the overheating problem is resolved only when both the cylinder and the motor are cooled down altogether.

Furthermore, when the cylinder is overheated, the outlet pipe connected to the cylinder would also have a high temperature. On one head, the outlet pipe's material would deteriorate. On the other hand, the user may be scalded by the outlet pipe or its metallic parts. The released air may also have a high temperature, and the inflated object (such as balloons, air-filled toys) may be damaged as well.

SUMMARY OF THE INVENTION

Therefore, a major objective is to provide a novel air compressor capable of conducting outside cool air through the air compressor through multiple air flow paths for effectively and speedily cooling down the motor and cylinder of the air compressor. The air compressor contains a casing member, a driving member, a cylinder member, an inlet pipe, and an outlet pipe. Inside the casing member, there is a hollow first accommodation section, a hollow second accommodation section, and a hollow connection section connecting the first and second accommodation sections. The first accommodation section has a number of first inlets and first outlets. The connection section has a number of second outlets. The driving member is located outside the casing member between the first and second accommodation sections, and is adjacent to the first outlets. The cylinder member is located both in the second accommodation section and the connection section. The inlet pipe has a first end connecting the second accommodation section. The outlet pipe has a first end connecting the cylinder member, and a second end extended outside the casing member. The driving member draws outside cool air into the casing member through the first inlets and engages the cylinder member to release compressed air through the outlet pipe. A portion of the drawn air is released outside through the first outlets, thereby forming a first flow path for cooling down the driving member. Another portion of the drawn air is released outside through the second outlets, thereby forming a second flow path for cooling down the cylinder member and the outlet pipe. In other words, the present invention can achieve enhanced heat dissipation by multiple flow paths through the driving and cylinder members.

Another objective of the present invention is provide a novel air compressor having a partition plate configured inside the connection section extended from an inner wall of the connection section towards the second outlets. A second end of the inlet pipe is configured above the partition plate, and is opened towards the same direction of outside air flow. As such, air drawn into the second end of the inlet pipe is in a direction opposite to outside air flow, effectively avoiding dust particles in the air entering and damaging the cylinder member.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become apparent to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
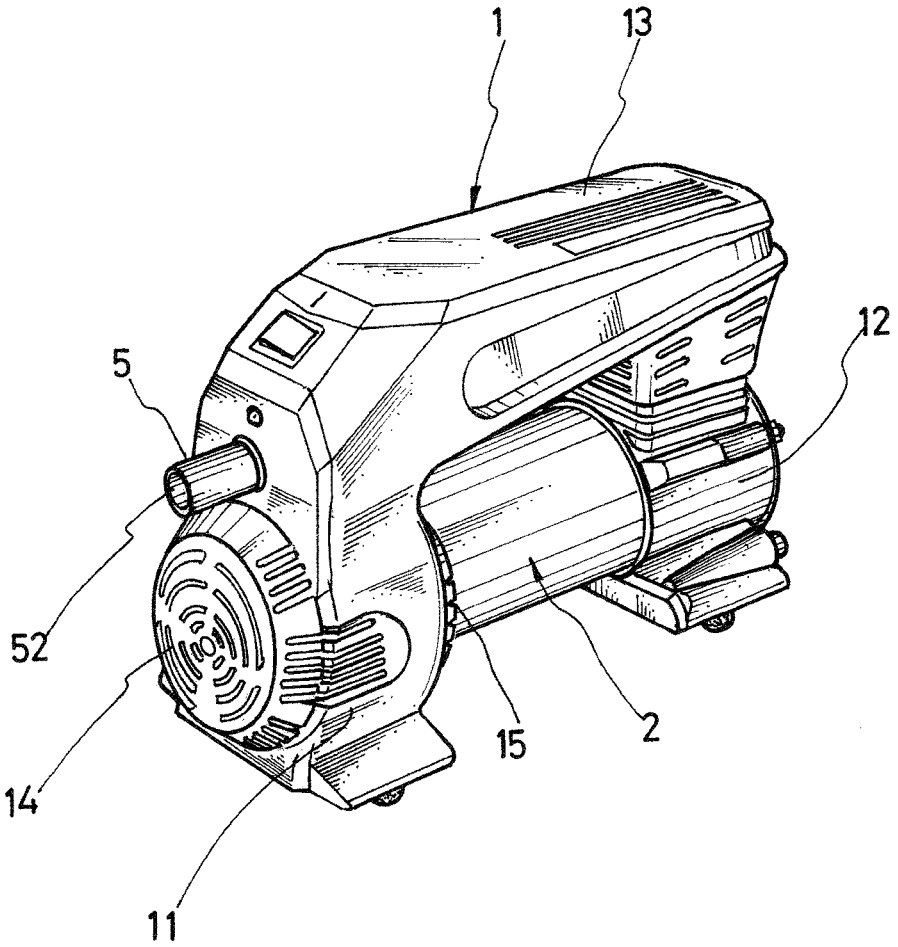
FIG. 1 is a perspective diagram showing an air compressor according to an embodiment of the present invention.
Figure 2:
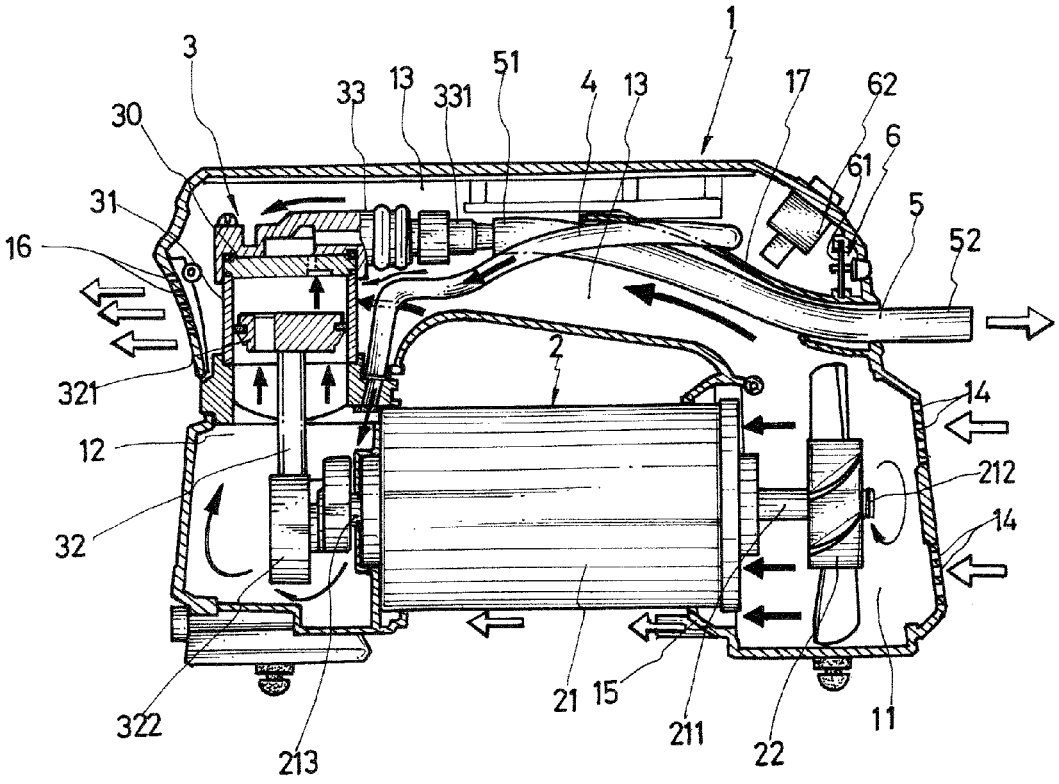
FIG. 2 is a side-view sectional diagram showing the air compressor of FIG. 1.
Figure 3:
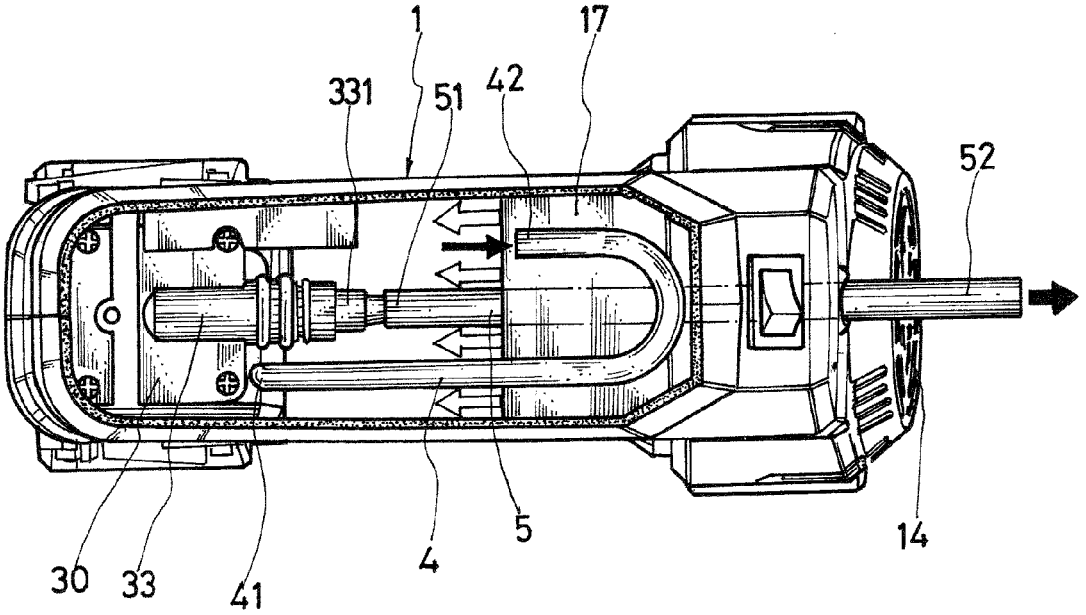
FIG. 3 is a top-view sectional diagram showing the air compressor of FIG. 1.

As illustrated in FIGS. 1 to 3, an air compressor according to an embodiment of the present invention contains a casing member 1, a driving member 2, a cylinder member 3, an inlet pipe 4, and an outlet pipe 5.

Inside the casing member 1, there is a hollow first accommodation section 11, a hollow second accommodation section 12, and a hollow connection section 13 connecting the first and second accommodation sections 11 and 12. In the present embodiment, the connection section 13 is located above the first and second accommodation sections 11 and 12, and a space is formed outside the casing member 1 beneath the connection section 13 and between the first and second accommodation sections 11 and 12. The casing member 1 has a number of first inlets 14 on a front side of the first accommodation section 11 and a number of first outlets 15 on an opposite back side of the first accommodation section 11, both connecting the first accommodation section 11 with the outside of the casing member 1. In the present embodiment, the first outlets 15 are positioned adjacent to a bottom edge of the back side of the first accommodation section 11 so that they are distant from the connection section 13. The connection section 13 has a number of second outlets 16 adjacent to the second accommodation section 12. A partition plate 17 is configured inside the connection section 13 adjacent to the first accommodation section 11, and is extended from an inner wall of the connection section 13 towards the second outlets 16.

The driving member 2 contains a motor 21 and a fan 22. The motor 21 is located outside the casing member 1 in the above-mentioned space between the first and second accommodation sections 11 and 12. The motor 21 has a shaft 211. A first end 212 of the shaft 211 is extended into the first accommodation section 11, and a second end 213 of the shaft 211 is extended into the second accommodation section 12. The fan is joined to the first end 212 of the shaft 211 and is housed in the first accommodation section 11.

The cylinder member 3 is located both in the second accommodation section 12 and the connection section 13, and contains a cylinder 31, a connecting rod 32, and a tube 33. The cylinder 31 is located inside the connection section 13 above the second accommodation section 12. The connecting rod 32 has one end joined to a piston 321 and the other end joined to a crank shaft 322. The piston 321 is housed inside the cylinder 31. The crankshaft 322 is housed in the second accommodation section 12 and joined to the second end 213 of the shaft 211. The tube 33 is joined to a top cover 30 of the cylinder 31. The tube 33 has an outlet 331.

The inlet pipe 4 is located inside the connection section 13. The inlet pipe 4 has a first end 41 connecting the second accommodation section 12, and a second end 42 located above the partition plate 17. The inlet pipe 4 has a curved section as it runs towards the second end 42 and, as such, the second end 42 opens towards the second outlets 16.

The outlet pipe 5 is located inside the connection section 13. The outlet pipe 5 has a first end 51 connecting the outlet 331 of the tube 33, and a second end 52 extended outside the casing member 1.

The air compressor further contains a control member 6 configured on the casing member 1. The control member 6 contains a control circuit 61 electrically connecting the driving member 2, and a control switch 62 for turning the driving member 2 on or off.

The motor 21 of the driving member 2 drives the fan 22 to spin so as to draw outside cool air into the casing member 1. In the meantime, the crankshaft 322 of the motor 21 is rotated and the connecting rod 32 is engaged into an up-down reciprocal motion, thereby actuating the cylinder member 3. As the cylinder member 3 operates, the compressed air produced by the cylinder member 3 is released to outside the casing member 1 through the tube 33, the outlet 331, and the outlet pipe 5.

More specifically, when the fan 22 of the driving member 2 spins as shown in FIG. 2, outside cool air is drawn into the casing member 1 through the first inlets 14. A portion of the drawn air is released outside through the first outlets 15 of the first accommodation section 11, thereby forming a first flow path for cooling down the motor 21 of the driving member 2. Another portion of the drawn air is released outside through the second outlets 16 via the connection section 13, thereby forming a second flow path for cooling down the cylinder member 3 and its heat dissipation fins.

In other words, the present invention can effectively conduct outside air through the driving member 2 and the cylinder member 3 by multiple flow paths for enhanced heat dissipation so as to avoid problems such as performance drop due to overheating, burning down parts, etc. In addition, as air flow through the connection section 13, the outlet pipe 5 is also cooled.

Please note that the second end 42 of the inlet pipe 4 is positioned above the partition plate 17, and is opened towards the same direction of outside air flow, as shown in FIGS. 2 and 3. As such, air entering the second end 42 of the inlet pipe 4 is in a direction opposite to the second flow path, effectively avoiding dust particles in the outside air entering and damaging the cylinder member 3. In other words, the inlet pipe 4 allows outside cool air to enter into the second accommodation section 12, thereby cooling down the cylinder member 3.

Figure 4:
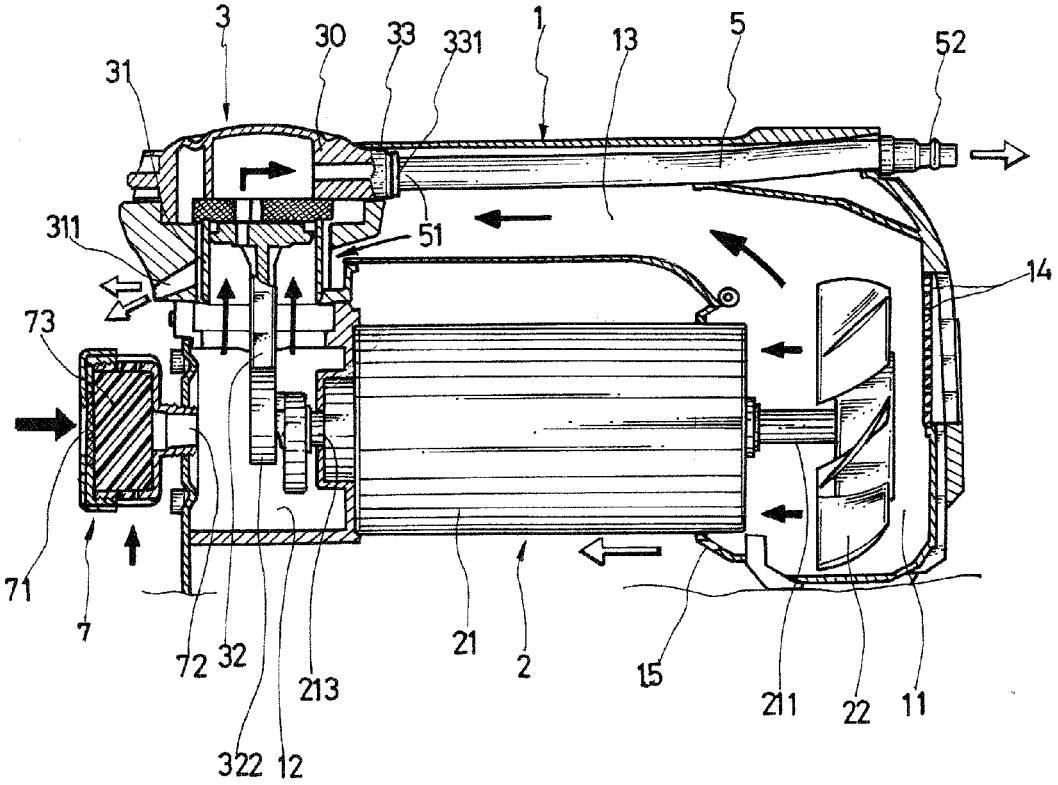
FIG. 4 is a side-view sectional diagram showing an air compressor according to another embodiment of the present invention.

An air compressor according to another embodiment of the present invention is shown in FIG. 4. As illustrated, the air compressor further contains a filter member 7 outside the casing member 1 joined to the second accommodation section 12. The filter member 7 has an inlet 71 at one end, an outlet 72 at an opposite end connecting to the second accommodation section 12, and a filtration element 73 inside. The outside cool air therefore enters the second accommodation section 12 sequentially through the inlet 71, the filtration element 73, and the outlet 72. By the filtering function of the filtration element 73, dust particles in the air are therefore prevented from entering and damaging the cylinder member 3. Again, the outside cool air is introduced into the second accommodation section 12, thereby cooling down the cylinder member 3.

The cylinder member 3 is located both in the second accommodation section 12 and the connection section 13. The cylinder 31 of the cylinder member 3 is tightly joined to a top portion of the second accommodation section 12, the tube 33 is tightly joined to the connection section 13. In addition, heat dissipating fin channels 311 are configured on the surface of the cylinder 31. Therefore outside cool air flows towards the cylinder member 3 through the connection section 13, and then flows outside the casing member 1 through the heat dissipating fin channels 311, thereby cooling down the cylinder member 3.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An air compressor, comprising:

a casing member having a hollow first accommodation section, a hollow second accommodation section, and a hollow connection section located above and connecting the first and second accommodation sections, where the first accommodation section has a plurality of first inlets on a front side and a plurality of first outlets on a back side of the first accommodation section, the connection section has a plurality of second outlets adjacent to the second accommodation section;

a driving member comprising a motor and a fan, where the motor is located outside the casing member between the first and second accommodation sections, and the fan is housed in the first accommodation section and joined to a first end of a shaft of the motor;

a cylinder member located both in the second accommodation section and the connection section adjacent to the second outlets and engaged by the driving member;

a partition plate configured inside the connection section adjacent to the first accommodation section extended from an inner wall of the connection section towards the second outlets;

an inlet pipe located inside the connection section having a first end connected to the second accommodation section, a second end located above the partition plate opening towards the second outlets, and a curved section in-between adjacent the second end;

an outlet pipe located inside the connection section having a first end connected to the cylinder member;

wherein the fan draws outside cool air into the casing member through the first inlets; a portion of the drawn air is released outside through the first outlets, thereby forming a first flow path;

the first outlets are adjacent to a bottom edge of the back side of the first accommodation section and beneath the motor for cooling down the motor;

a part of another portion of the drawn air, under the guidance of the partition plate, is released outside through the second outlets, thereby forming a second flow path for cooling down the cylinder member; and another part of another portion of the drawn air enters the second end of the inlet pipe in a direction opposite to the second flow path and then into the second accommodation section, cooling down the cylinder member while effectively avoiding dust particles in the outside air entering and damaging the cylinder member.

2. The air compressor according to claim 1, wherein the cylinder member comprises a cylinder, a connecting rod, and a tube; the cylinder is located inside the connection section above the second accommodation section; the connecting rod has one end joined to a piston and the other end joined to a crank shaft; the piston is housed inside the cylinder; the crankshaft is housed in the second accommodation section and joined to a second end of the shaft of the motor; the tube is joined to a top cover of the cylinder; and the tube has an outlet connected to the first end of the outlet pipe.

* * * * *